US010563354B2

(12) United States Patent
Tyson et al.

(10) Patent No.: US 10,563,354 B2
(45) Date of Patent: Feb. 18, 2020

(54) HYDROPHOBIC AND/OR AMPHIPHOBIC ROLL COVER

(71) Applicant: Stowe Woodward Licensco, LLC, Raleigh, NC (US)

(72) Inventors: Chris Tyson, Clearbrook, VA (US); Charles Hunter, Winchester, VA (US); Jun Xu, Frederick, MD (US)

(73) Assignee: Stowe Woodward Licensco LLC, Youngsville, NC (US)

( * ) Notice: Subject to any disclaimer, the term of this patent is extended or adjusted under 35 U.S.C. 154(b) by 184 days.

(21) Appl. No.: 13/834,356

(22) Filed: Mar. 15, 2013

(65) Prior Publication Data

US 2013/0266808 A1 Oct. 10, 2013

Related U.S. Application Data

(60) Provisional application No. 61/621,037, filed on Apr. 6, 2012.

(51) Int. Cl.
*D21F 3/08* (2006.01)
*D21G 1/02* (2006.01)

(52) U.S. Cl.
CPC ..... *D21F 3/08* (2013.01); *D21G 1/0233* (2013.01); *Y10T 428/2947* (2015.01)

(58) Field of Classification Search
CPC .. B32B 1/08; B32B 3/26; B32B 3/263; B32B 3/30; B32B 7/02; B32B 7/12; B32B 2307/73; D21G 1/0246; D21G 1/0253; D21F 3/08; D21F 3/086; Y10T 428/2462; Y10T 428/24669
USPC ..... 428/156, 159, 160, 172, 173, 174, 36.9, 428/36.91, 36.8; 100/155 R
See application file for complete search history.

(56) References Cited

U.S. PATENT DOCUMENTS 2,668,151 A * 2/1954 Pedlow, Jr. ..... C07F 7/025 106/287.1
3,561,493 A * 2/1971 Maillard ..... F16L 9/121 138/141
4,224,372 A 9/1980 Romanski
4,859,396 A 8/1989 Krenkel et al.
4,880,879 A * 11/1989 Bauman ..... C08F 8/22 525/130
4,978,428 A 12/1990 Cronin et al.
5,997,456 A 12/1999 Butters et al.
(Continued)

FOREIGN PATENT DOCUMENTS

CN 1366109 8/2002
DE 19651557 A1 * 6/1998 ..... B29C 70/086
(Continued)

OTHER PUBLICATIONS

Machine translation of DE 10 2012 205899. Obtained from EPO on Mar. 10, 2016.*
(Continued)

*Primary Examiner* — Megha M Gaitonde
(74) *Attorney, Agent, or Firm* — Myers Bigel, P.A.

(57) ABSTRACT

The present invention relates generally to an industrial roll, comprising: a substantially cylindrical metallic core; a base layer that is adhered to and circumferentially overlies the core; a polymeric topstock layer that circumferentially overlies the base layer; and a hydrophobic and/or amphiphobic coating that circumferentially overlies the topstock layer.

13 Claims, 3 Drawing Sheets

(56) References Cited

U.S. PATENT DOCUMENTS

| | | | | |
|---|---|---|---|---|
| 6,265,457 | B1 * | 7/2001 | Dolgopolsky | C08G 18/4072 521/134 |
| 6,328,681 | B1 | 12/2001 | Stephens | |
| 6,554,754 | B2 | 4/2003 | VanRens | |
| 6,699,368 | B2 | 3/2004 | Ishii et al. | |
| 6,905,734 | B2 | 6/2005 | Withers et al. | |
| 7,056,845 | B2 * | 6/2006 | Waeber | D06M 11/79 106/2 |
| 7,261,680 | B2 * | 8/2007 | Lutz | B30B 3/00 100/35 |
| 2001/0051567 | A1 * | 12/2001 | Schaschke | B41N 7/00 492/56 |
| 2003/0068447 | A1 * | 4/2003 | Carling | B05D 7/02 427/535 |
| 2003/0111871 | A1 | 6/2003 | De Gaillard | |
| 2003/0224917 | A1 | 12/2003 | Lutz | |
| 2004/0014573 | A1 | 1/2004 | Vergara | |
| 2005/0186379 | A1 * | 8/2005 | Rhee | B32B 27/08 428/36.91 |
| 2005/0261115 | A1 | 11/2005 | Moore et al. | |
| 2007/0111871 | A1 | 5/2007 | Butterfield et al. | |

FOREIGN PATENT DOCUMENTS

| | | | | |
|---|---|---|---|---|
| DE | 102012205899 | A1 * | 10/2013 | D21H 23/56 |
| EP | 311531 | A1 * | 4/1989 | D21F 3/08 |
| EP | 0 924 337 | A2 | 6/1999 | |
| EP | 1 225 272 | A1 | 7/2002 | |
| EP | 1 788 152 | A1 | 5/2007 | |
| JP | 2001-304243 | | 10/2001 | |
| JP | 2001-524199 | | 11/2001 | |
| JP | 2002-139923 | | 5/2002 | |
| JP | 2004-151533 | | 5/2004 | |
| JP | 2007-186839 | | 7/2007 | |
| JP | 2008-533316 | | 8/2008 | |
| JP | 2009242711 | A | 10/2009 | |
| WO | WO 2007/068760 | A2 | 6/2007 | |
| WO | WO 2009/125057 | A1 | 10/2009 | |
| WO | WO 2013/037525 | A1 | 3/2013 | |
| WO | WO 2013/037526 | A1 | 3/2013 | |

OTHER PUBLICATIONS

Machine translation of DE 19651557. Obtained from EPO on Mar. 10, 2016.*

International Preliminary Report on Patentability Corresponding to International Application No. PCT/US2013/031966, dated Oct. 16, 2014.

International Search Report and the Written Opinion of the International Searching Authority, or the Declaration, dated Jun. 13, 2013 (10 pages).

Deng et al., Candle Soot as a Template for a Transparent Robust Superamphiphobic Coating, Science, Jan. 6, 2012, pp. 67-70, vol. 335.

* cited by examiner

HYDROPHOBIC AND/OR AMPHIPHOBIC ROLL COVER

RELATED APPLICATIONS

This application claims the benefit of and priority from U.S. Provisional Application Ser. No. 61/621,037, filed on Apr. 6, 2012, the disclosure of which is hereby incorporated herein by reference in its entirety.

FIELD

The present invention relates generally to industrial rolls, and more particularly to covers for industrial rolls.

BACKGROUND

Cylindrical rolls are utilized in a number of industrial applications, especially those relating to papermaking. Such rolls are typically employed in demanding environments in which they can be exposed to high dynamic loads and temperatures and aggressive or corrosive chemical agents. As an example, in a typical paper mill, rolls are used not only for transporting a fibrous web sheet between processing stations, but also, in the case of press section and calender rolls, for processing the web sheet itself into paper.

Typically rolls used in papermaking are constructed with the location within the papermaking machine in mind, as rolls residing in different positions within the papermaking machines are required to perform different functions. Because papermaking rolls can have many different performance demands, and because replacing an entire metallic roll can be quite expensive, many papermaking rolls include a polymeric cover that surrounds the circumferential surface of a metallic core. By varying the polymer or elastomer employed in the cover, the cover designer can provide the roll with different performance characteristics as the papermaking application demands. Also, repair, regrinding or replacement of a cover over a metallic roll can be considerably less expensive than the replacement of an entire metallic roll.

In many instances, the roll cover will include at least two distinct layers: a base layer that overlies the core and provides a bond thereto; and a topstock layer that overlies and bonds to the base layer and serves the outer surface of the roll (some rolls will also include an intermediate "tie-in" layer sandwiched by the base and top stock layers). The layers for these materials are typically selected to provide the cover with a prescribed set of physical properties for operation. These can include the requisite strength, elastic modulus, and resistance to elevated temperature, water and harsh chemicals to withstand the papermaking environment. In addition, covers are typically designed to have a predetermined surface hardness that is appropriate for the process they are to perform, and they typically require that the paper sheet "release" from the cover without damage to the paper sheet. Also, in order to be economical, the cover should be abrasion- and wear-resistant.

There may be a need for papermaking roll covers that have different balances of properties, particularly sheet release and water diffusion.

SUMMARY

As a first aspect, embodiments of the invention are directed to an industrial roll, comprising: a substantially cylindrical metallic core; a base layer that is adhered to and circumferentially overlies the core; a polymeric topstock layer that circumferentially overlies the base layer; and a hydrophobic and/or amphiphobic coating that circumferentially overlies the topstock layer.

As a second aspect, embodiments of the invention are directed to an industrial roll, comprising: a substantially cylindrical metallic core; a base layer that is adhered to and circumferentially overlies the core; a polymeric topstock layer that circumferentially overlies the base layer and comprises a hydrophobic and/or amphiphobic compound in an amount sufficient to render the topstock layer hydrophobic and/or amphiphobic.

As a third aspect, embodiments of the invention are directed to an industrial roll, comprising: a substantially cylindrical metallic core; a base layer that is adhered to and circumferentially overlies the core; a polymeric topstock layer that circumferentially overlies the base layer, wherein the topstock layer comprises a plurality of recesses having an interior surface coated with a hydrophobic and/or amphiphobic coating.

As a further aspect, embodiments of the invention are directed to a method of constructing an industrial roll having a hydrophobic and/or amphiphobic coating, the method comprising the steps of: providing a substantially cylindrical metallic core; applying a base layer that circumferentially overlies the core; and applying a bi-layer over the base layer, the bi-layer comprising a topstock layer that circumferentially overlies the base layer and a hydrophobic and/or amphiphobic coating that circumferentially overlies the topstock layer.

DESCRIPTION

Figure 1:
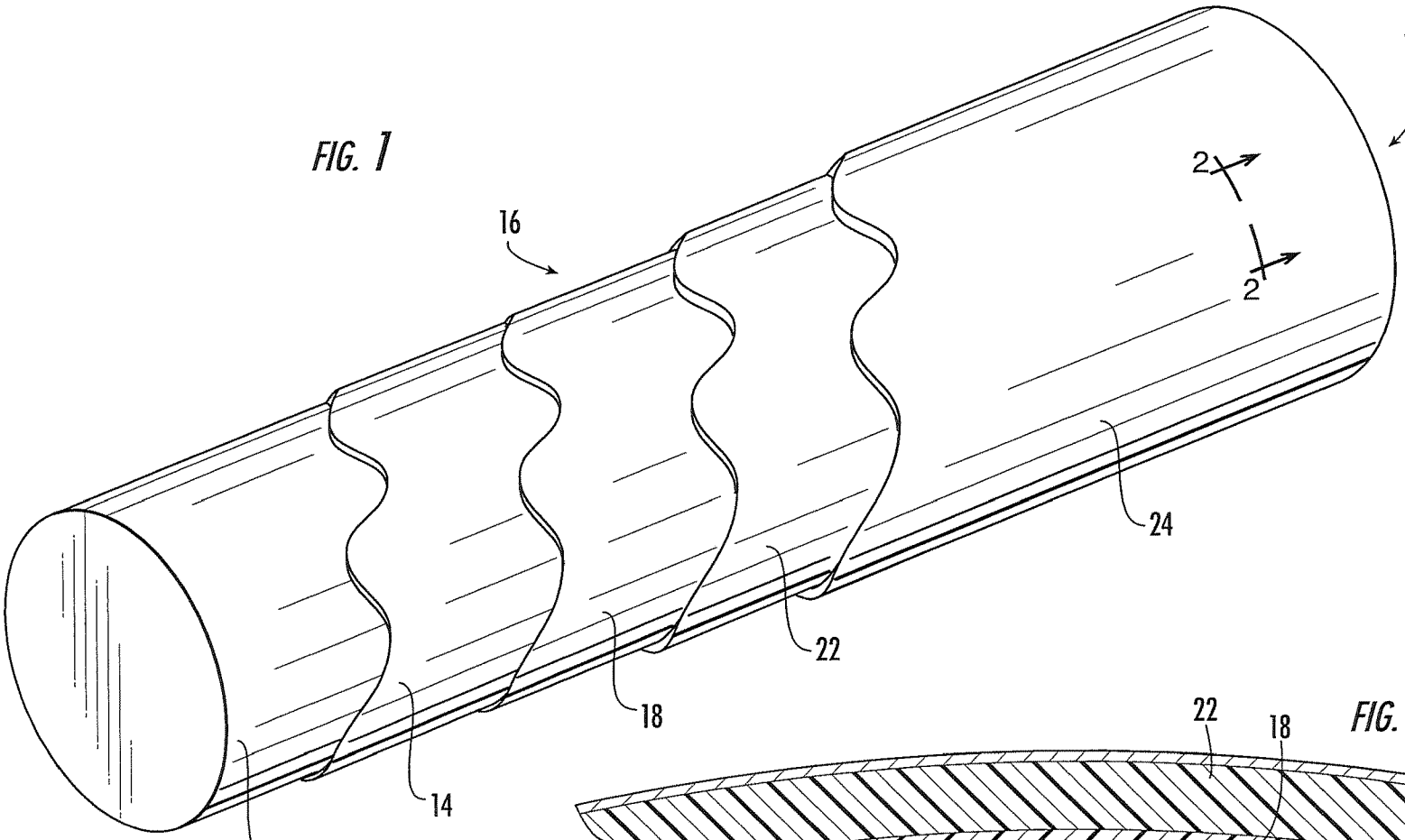
FIG. 1 is a perspective cutaway view of an industrial roll according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. As used herein, the term "and/or" includes any and all combinations of one or more of the associated listed items. Where used, the terms "attached," "connected," "interconnected," "contacting," "coupled," "mounted," "overlying" and the like can mean either direct or indirect attachment or contact between elements, unless stated otherwise.

The term "about," as used herein when referring to a measurable value, such as an amount or concentration, encompasses variations of the specified measurable value as well as the specified value, and may encompass variations of ±10%, ±5%, ±1%, ±0.5%, ±0.1%, or the like. For example, "about X" where X is the measurable value, is meant to include X as well as variations of X that may include ±10%, ±5%, ±1%, ±0.5%, ±0.1%, or the like. A range provided herein for a measureable value may include any other range and/or individual value therein.

Figure 2:
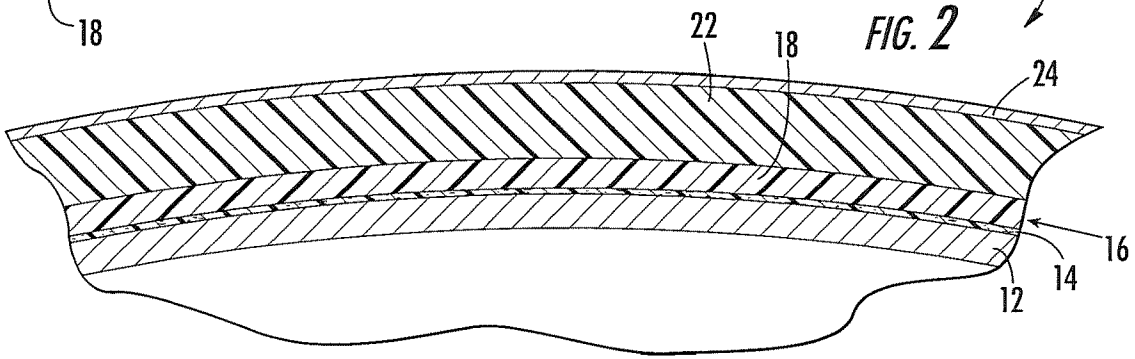
FIG. 2 is a greatly enlarged, partial section view of the roll of FIG. 1 taken along lines 2-2 thereof.

Referring now to the figures, a roll, designated broadly at 10, is illustrated in FIGS. 1 and 2. The roll 10 includes in overlying relationship a core 12 (typically metallic), an adhesive layer 14, and a cover 16. Each of these components is discussed in greater detail herein below.

The core 12 is a substantially cylindrical, hollow structure typically formed of steel, some other metal, or even a composite material. The core 12 is typically between about 1.5 and 400 inches in length and 1 and 70 inches in diameter, with lengths between about 100 and 400 inches and diameters of between about 20 and 70 inches being common for papermaking purposes. At these more common length and diameter ranges, the core 12 typically has walls between about 1 and 5 inches in thickness. Components such as journals and bearings (not shown) are typically included on the core 12 to facilitate its mounting and rotation in a papermaking machine. The surface of the core 12 may be treated by blasting, sanding, sandblasting, or the like to prepare the surface for bonding to the adhesive layer 14.

Referring again to FIGS. 1 and 2, the adhesive layer 14 comprises an adhesive (typically an epoxy adhesive) that can attach the core 12 to the cover 16. Of course, the adhesive comprising the adhesive layer 14 should be chosen to be compatible with the materials of the core 12 and the base layer 18 of the cover 16 (i.e., it should provide a high-integrity bond between these structures without unduly harming either material); preferably, the bond has a tensile bond strength of between about 1,200 and 5,000 psi. The adhesive may have additives, such as curing agents, that facilitate curing and physical properties. Exemplary adhesives include Chemlok 220X and Chemlok 205, which are epoxy adhesives available from Lord Corporation, Raleigh, N.C.

The adhesive layer 14 can be applied to the core 12 in any manner known to be suitable to those skilled in this art for applying a thin layer of material. Exemplary application techniques include spraying, brushing, immersion, scraping, and the like. It is preferred that, if a solvent-based adhesive is used, the adhesive layer 14 be applied such that the solvent can evaporate prior to the application of the cover 16 in order to reduce the occurrence of trapped solvent that can cause "blows" during the curing process. Those skilled in this art will appreciate that the adhesive layer 14 may comprise multiple coats of adhesive, which may comprise different adhesives; for example, two different epoxy adhesives with slightly different properties may be employed. It should also be noted that, in some embodiments, the adhesive layer may be omitted entirely, such that the cover 16 is bonded directly to the core 12.

Still referring to FIGS. 1 and 2, the cover 16 comprises, in overlying relationship, a base layer 18, a topstock layer 22 and a coating 24. In the illustrated embodiment, the base layer 18 is adhered to the adhesive layer 14. The base layer 18 comprises a polymeric compound that typically includes fillers and other additives. Exemplary polymeric compounds include, but are not limited to, polyurethane, natural rubber and synthetic rubbers such as nitrile-butadiene rubber (NBR) and hydrogenated nitrile-butadiene rubber (HNBR), an ethylene-propylene terpolymer formed of ethylene-propylene diene monomer (EPDM), chlorosulfonated polyethylene (CSPE), styrene butadiene (SBR), chioroprene (CR), neoprene, isoprene, silicone, fluoroelastomers, thermoset composites, and blends and co-polymers thereof, including blends with polyvinylchloride (PVC). In some embodiments, the base layer 18 comprises a thermoset based composite. An exemplary polymeric material that may be suitable for use in the base layer 18 is epoxy. Additional components, such as monomers and monomer coagents like trimethyl propane trimethacrylate and 1,3-butylene glycol dimethacrylate, may be added to the base layer 18 to enhance polymerization.

Fillers are typically added to the base layer 18 to modify the physical properties of the compound and/or to reduce its cost. Exemplary filler materials include, but are not limited to, inorganic oxides such as aluminum oxide ($Al_2O_3$), silicon dioxide ($SiO_2$), magnesium oxide (MgO), calcium oxide (CaO), zinc oxide (ZnO) and titanium dioxide ($TiO_2$), carbon black (also known as furnace black), silicates such as clays, talc, wollastonite ($CaSiO_3$), magnesium silicate ($MgSiO_3$), anhydrous aluminum silicate, and feldspar ($KAlSi_3O_8$), sulfates such as barium sulfate and calcium sulfate, metallic powders such as aluminum, iron, copper, stainless steel, or nickel, carbonates such as calcium carbonate ($CaCo_3$) and magnesium carbonate ($MgCo_3$), mica, silica (natural, fumed, hydrated, anhydrous or precipitated), and nitrides and carbides, such as silicon carbide (SiC) and aluminum nitride (AlN). These fillers may be present in virtually any form, such as powder, pellet, fiber or sphere.

Also, the base layer 18 may optionally include other additives, such as polymerization initiators, activators and accelerators, curing or vulcanizing agents, plasticizers, heat stabilizers, antioxidants and antiozonants, coupling agents, pigments, and the like, that can facilitate processing and enhance physical properties. These components are generally compounded into the polymer prior to the time of application of the base layer 18 to the adhesive layer 14 or directly to the core 12. Those skilled in this art will appreciate that the identity and amounts of these agents and their use in a base layer are generally known and need not be described in detail herein.

The base layer 18 can be applied by any manner known to those skilled in this art to be suitable for the application of polymers to an underlying surface. In some embodiments (particularly those applying a rubber base), the base layer 18 is applied through an extrusion process in which strips of the base layer 18 are extruded through an extrusion die, then, while still warm, are overlaid over the adhesive layer 14 as it is still somewhat tacky. The base layer strips are preferably between about 0.030 and about 0.125 inches in thickness and are applied in an overlapping manner, with the result that total thickness of the base layer 18 is typically between about 0.0625 inches and about 1 inch, in some embodiments between about 0.1 inches and about 0.5 inches, and in further embodiments between about 0.1 inches and about 0.25 inches. Those skilled in this art will appreciate that, in some embodiments, the base layer 18 may be omitted such that the topstock layer 22 is adhered directly to the adhesive layer 14 or, in the absence of an adhesive layer, to the core 12.

Referring again to FIGS. 1 and 2, in the illustrated embodiment, the topstock layer 22 circumferentially overlies and, unless one or more tie-in layers are included as described below, is adhered to the base layer 18. The topstock layer 22 comprises a rubber compound, such as NBR, HNBR, EPDM, CSM, or natural rubber, or a polyurethane compound known to those skilled in this art to be suitable for use in papermaking machine rolls. Typically the topstock layer 22 includes fillers and other additives, and may include one or more recesses, such as grooves, through holes and/or blind drilled holes, if desired. Conventionally, a rubber topstock layer 22 will overlie a rubber base layer 18, whereas a polyurethane topstock layer 22 will overlie an epoxy base layer 18 via casting the polyurethane layer.

Exemplary fillers include, but are not limited to, silicone dioxide, carbon black, clay, and titanium dioxide ($TiO_2$) as well as others set forth hereinabove in connection with the base layer 18. Typically, fillers are included in an amount of between about 3 and 70 percent by weight of the topstock layer 22. The fillers can take virtually any form, including powder, pellet, bead, fiber, sphere, or the like.

Exemplary additives include, but are not limited to, polymerization initiators, activators and accelerators, curing or vulcanizing agents, plasticizers, heat stabilizers, antioxidants, coupling agents, pigments, and the like, that can facilitate processing and enhance physical properties. Those skilled in this art will understand the types and concentrations of additives that are appropriate for inclusion in the topstock layer 22, so these need not be discussed in detail herein.

The topstock layer 22 can be applied over the base layer 18 by any technique known to those skilled in this art to be suitable for the application of elastomeric materials over a cylindrical surface. Preferably, the components of the topstock layer 22 are mixed separately, then blended in a mill. The blended material is transferred from the mill to an extruder, which extrudes feed strips of top stock material onto the base layer 18. Alternatively, either or both of the base and top stock layers 18, 22 can be applied through the overlaying of calendered sheets of material.

In some embodiments, the topstock layer 22 is applied such that it is between about 0.25 inches and about 2.5 inches in thickness (at higher thickness, multiple passes of material may be required). In some embodiments, the topstock layer 22 has a thickness between about 0.5 inches and about 1.5 inches and in some embodiments between about 1 inch and about 1.5 inches. It is also suitable for the thickness of the top stock layer 22 be between about 50 and 90 percent of the total cover thickness (i.e., the total thickness of the combined base and topstock layers 18, 22 and coating 24). The rubber compounds of the base layer 18 and the topstock 22 may be selected such that the base layer 18 has a higher hardness value than the topstock layer 22. As an example, the base layer 18 may have a hardness of between about 1 and 100 P&J (in some embodiments, between 3 and 100 P&J, and in other embodiments, between 3 and 20 P&J), and the top stock layer 22 may have a hardness of between about 30 and 300 P&J (in some embodiments between 30 and 250 P&J). The graduated hardness concept can reduce the bond line shear stresses that can occur due to mismatches of the elastic properties (such as elastic modulus and Poisson's ratio) of the various layers in the cover constructions. This reduction in interface shear stress can be important in maintaining cover integrity.

Those skilled in this art will also appreciate that the roll 10 may be constructed with a tie-in layer sandwiched between the base layer 18 and the topstock layer 22, such that the tie-in layer would directly underlie the top stock layer 22. The typical properties of a tie-in layer are well-known to those skilled in this art and need not be described in detail herein.

After the topstock 22 has been applied, these layers of the cover 16 are then cured, typically in an autoclave, for a suitable curing period (generally between about 16 and 30 hours). After curing, it is preferred that any crust that has developed is skimmed from the surface of the top stock layer 22, and that the top stock layer 22 is ground for dimensional correctness.

Referring once again to FIGS. 1 and 2, the coating 24 is then applied over the topstock 22. The coating 24 comprises a hydrophobic compound and/or an amphiphobic compound and optionally a matrix material. "Hydrophobic," as used herein in reference to a surface, coating, and the like, refers to a surface that has a contact angle greater than 90° for water, and in some embodiments, a contact angle greater than 120°, 130°, or even 140° for water. "Amphiphobic," as used herein in reference to a surface, coating, and the like, refers to a surface that has a contact angle greater than 90° for water and an organic liquid, and in some embodiments, a contact angle greater than 120°, 130°, or even 140° for water and an organic liquid. "Organic liquid," as used herein, refers to a hydrophobic compound comprising carbon and hydrogen. Exemplary organic liquids include, but are not limited to, an oil, a fat, an alkane, an alkylene, an alkyne, an arene, and any combination thereof. The coating 24 comprises a sufficient amount of a hydrophobic and/or amphiphobic compound to render the outer surface of roll cover 16 hydrophobic and/or amphiphobic. A hydrophobic roll cover 16 can repel water and an amphiphobic roll cover 16 can repel water and an organic liquid.

According to some embodiments, the coating 24 comprises a superhydrophobic compound and/or a superamphiphobic compound and optionally a matrix material. "Superhydrophobic," as used herein, refers to a surface that has a contact angle greater than 150° for water. "Superamphiphobic," as used herein, refers to a surface that has a contact angle greater than 150° for water and an organic liquid.

Any method known to those of skill in the art can be used to measure the contact angle of water or an organic liquid, such as, but not limited to the static sessile drop method, the dynamic sessile drop method, optical tensiometry, force tensiometry, and any combination thereof. The contact angle of a drop of water or an organic liquid on a surface of a substrate (e.g., the surface of the coating 24) can be measured. The drop can be about 1 μL to about 1 mL, or any range therein, such as, but not limited to, about 1 μL to about 500 μL, about 1 μL to about 30 μL, about 25 μL to about 100 μL, or about 3 μL to about 10 μL.

Exemplary hydrophobic and/or amphiphobic compounds include, but are not limited to, polytetrafluoroethylene (PTFE); polyethylene; hydrophobic and/or amphiphobic diatomaceous earth; a hydrophobic and/or amphiphobic nanomaterial such as, but not limited to, carbon, silica, and/or a metal oxide (e.g., boron oxide, titanium dioxide, vanadium pentaoxide, etc.) nanoparticle, nanorod, nanotube, nanofiber, nanopin, and/or the like; and any combination thereof. A hydrophobic and/or amphiphobic compound can have a size in a range of about 10 nm to about 500 μm or any range and/or individual value therein, such as about 10 nm to about 10 μm or about 10 nm to about 1 μm.

A surface of a hydrophobic and/or amphiphobic compound, such as, but not limited to a nanomaterial, may be modified with a chemical moiety. Modifying a surface of a hydrophobic and/or amphiphobic compound may increase and/or provide the desired hydrophobic and/or amphiphobic property and may be accomplished by chemically and/or physically bonding the moiety to a surface of the hydrophobic and/or amphiphobic compound. Exemplary chemical moieties that may be used to modify a surface of a hydrophobic and/or amphiphobic compound include, but are not limited to, a hydrocarbon, a fluorocarbon, a silicon containing compound such as a silane, an organic amine, stearic acid, t-butyltrichlorosilane, (3-acryloxypropyl)trimethoxy silane, methacryloxymethyltriethoxy silane, cyclopentyltrimethoxysilane, cyclohexyltrimethoxysilane, adamantylethyltrichlorosilane, 4-phenylbutyltrichlorosilane, 1-napthyltrimethoxysilane, (3,3,3-trifluoropropyl)trimethoxysilane, (tridecafluoro-1,1,2,2-tetrahydrooctyl)trichlorosilane, tridecafluoro-2-(tridecafluorohexyl) decyltrichlorosilane, (heptadecafluoro-1,1,2,2-tetrahydrodecyl)dimethylchlorosilane, dimethyldimethoxy silane, dodecylamine, octylamine, and any combination thereof.

Exemplary matrix materials include, but are not limited to, a polymeric compound, such as a rubber compound, an acrylic polymer, a polyurethane, an epoxy, a latex, etc. Exemplary rubber compounds include, but are not limited to, NBR, HNBR, EPDM, CSM, and/or a natural rubber. Exemplary polyurethane compounds include, but are not limited to, those formed from cast and ribbon flow processes and those described in U.S. Pat. No. 6,328,681, which is incorporated herein by reference in its entirety.

A hydrophobic and/or amphiphobic coating 24 can comprise a mixture of hydrophobic and/or amphiphobic compounds having different sizes and/or different morphologies. In certain embodiments, a hydrophobic and/or amphiphobic coating 24 can comprise a hydrophobic and/or amphiphobic compound that is uniform in size. In some embodiments, a hydrophobic and/or amphiphobic compound is mixed with a solvent (e.g., water and/or an organic liquid) and applied to a roll 10. In certain embodiments, a hydrophobic and/or amphiphobic compound is mixed with a matrix material and applied to a roll 10.

A hydrophobic and/or amphiphobic coating 24 can comprise about 1 part to about 100 parts of a hydrophobic and/or amphiphobic compound against 100 parts of a matrix material (e.g., a rubber and/or a polyurethane), or any range and/or individual value therein, such as, but not limited to, about 1 part to about 25 parts, about 5 parts to about 30 parts, about 10 parts to about 40 parts, about 15 part to about 45 parts, about 20 parts to about 80 parts, or about 50 parts to about 100 parts against a matrix material. In some embodiments, a hydrophobic and/or amphiphobic coating 24 comprises a mixture of PTFE powder and hydrophobic diatomaceous earth. A coating mixture can comprise about 1 part to about 50 parts of PTFE powder against a matrix material and about 1 part to about 50 parts of hydrophobic diatomaceous earth against a matrix material. In certain embodiments, a hydrophobic and/or amphiphobic coating 24 comprises a mixture comprising about 1 part to about 50 parts of PTFE powder against a matrix material, about 1 part to about 50 parts of hydrophobic diatomaceous earth against a matrix material, and about 1 part to about 50 parts of a hydrophobic nanomaterial, such as, but not limited to, nano-silica (e.g., a silica nanoparticle, nanorod, nanotube, nanofiber, nanopin, and/or the like), against a matrix material. In some embodiments, the hydrophobic nanomaterials comprise a surface coating comprising hydrocarbon and/or fluorocarbon compounds.

In some embodiments, the coating 24 comprises a mixture comprising about 30 parts or less of PTFE powder, about 10 parts of less of hydrophobic diatomaceous earth, and about 5 parts or less of a nanomaterial. Those skilled in this art will appreciate that a hydrophobic and/or amphiphobic compound can be present in substantially the same concentration throughout the coating 24 or the concentration of a hydrophobic and/or amphiphobic compound can vary throughout the coating 24. In some embodiments, the ratio of a hydrophobic and/or amphiphobic compound to a matrix material varies throughout the coating 24.

In certain embodiments, a hydrophobic and/or amphiphobic coating 24 is bionic. "Bionic," as used herein, refers to the structural similarity of the coating 24 to a hydrophobic and/or amphiphobic surface found in nature, such as, but not limited to, a surface of a lotus leaf. The coating 24 can resemble a natural hydrophobic and/or amphiphobic surface on the micro- and/or nano-scale. For example, bionic can refer to how a hydrophobic compound is organized to form the coating 24, the surface-energy of the coating 24, and/or a hierarchical micro- and/or nano-structure of the coating 24 compared to a natural hydrophobic and/or amphiphobic surface. In particular embodiments, the coating 24 is bionic in that it resembles a micro- and/or nano-scale structure of a surface of a lotus leaf. The coating 24 can self-assemble. "Self-assemble," as used herein, refers to the components of a hydrophobic and/or amphiphobic coating (e.g., a hydrophobic and/or amphiphobic compound, matrix, etc.) assembling into the hydrophobic and/or amphiphobic coating through their own interactions and without external guidance and/or means, such as, e.g., adding a catalyst, heat, light, pH, etc. (i.e., the coating 24 builds itself). In some embodiments, the coating 24 can self-assemble, but external means can influence a property of the coating 24, such as, but not limited to, the rate of assembly and/or hardness of the coating. In certain embodiments, the coating 24 is a self-assembled bionic micro- and/or nano-structure.

In some embodiments, a hydrophobic and/or amphiphobic coating 24 is between about 0.005 and 0.200 inches in thickness. In certain embodiments, a hydrophobic and/or amphiphobic coating has a hardness of between about 3 and 70 P&J, between about 3 and 30 P&J, or may even have a hardness of about 100 Shore D.

A hydrophobic and/or amphiphobic coating 24 may have other fillers and additives of the type described above in connection with the rubber compounds of the base and top stock layers 18, 22 that can modify or enhance its physical properties and manufacturing characteristics. Exemplary materials, additives and fillers are set forth in U.S. Pat. No. 4,224,372 to Romanski, U.S. Pat. No. 4,859,396 to Krenkel et al. and U.S. Pat. No. 4,978,428 to Cronin et al., the disclosures of each of which are hereby incorporated herein in their entireties.

A hydrophobic and/or amphiphobic coating 24 can be applied over the top stock 22 in any manner known to those skilled in this art, including extrusion, casting, spraying, roller coating, and the like. In certain embodiments, a hydrophobic and/or amphiphobic coating 24 may be applied to the topstock 22 by thermal spraying and/or solvent spraying.

Referring again to FIGS. 1 and 2, after application of the coating 24, the roll 10 may optionally be cured (typically via the application of heat), and may be ground and/or otherwise finished in a manner known to those skilled in this art.

Figure 3:
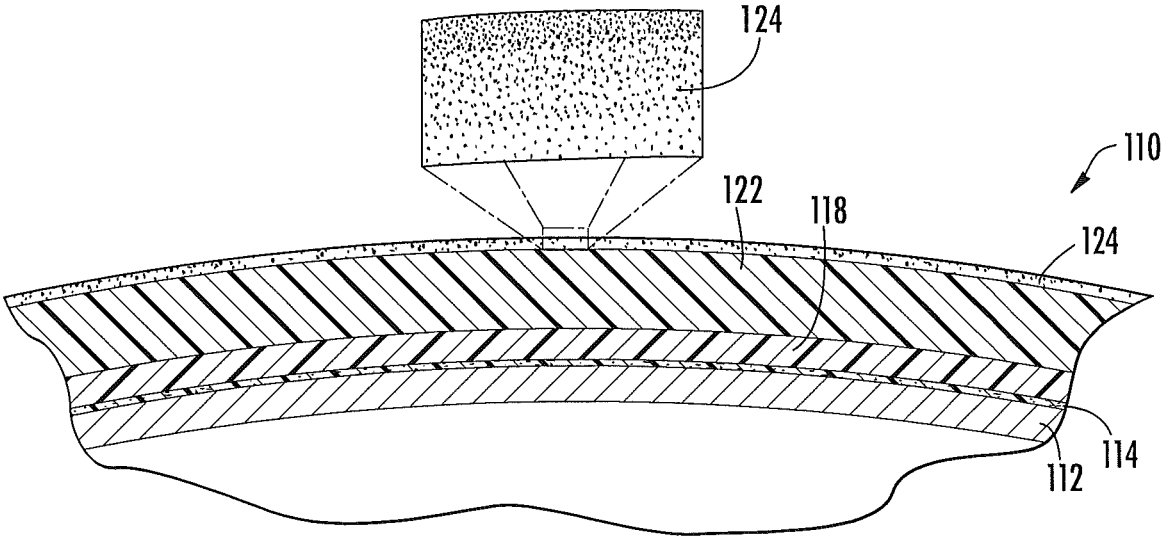
FIG. 3 is a greatly enlarged, partial section view of an industrial roll according to additional embodiments of the present invention.

Another embodiment of a roll cover, designated at 110, is illustrated in FIG. 3. The roll 110 comprises, in overlying relationship, a core 112, an adhesive layer 114, a base layer 118, a topstock layer 122, and a coating 124 comprising a concentration gradient of a hydrophobic and/or amphiphobic compound that increases in concentration as the coating 124 extends distally from the core 112. The coating 124 can comprise a single layer or two or more layers.

Referring to FIGS. 1-3, to address a potential issue of poor bonding between a hydrophobic and/or amphiphobic coating 24, 124 and the topstock 22, 122, it may be desirable to apply multiple layers of coating 24, 124 where the bottom layers of the coating contain minimum or no amounts of a hydrophobic and/or amphiphobic compound and increasing amounts of a hydrophobic and/or amphiphobic compound are provided in one or more top layers of the coating. Those skilled in the art will appreciate that when a coating comprises multiple layers, the concentration of a hydrophobic and/or amphiphobic compound can be selected to vary in any manner in the coating layers.

Figure 4:
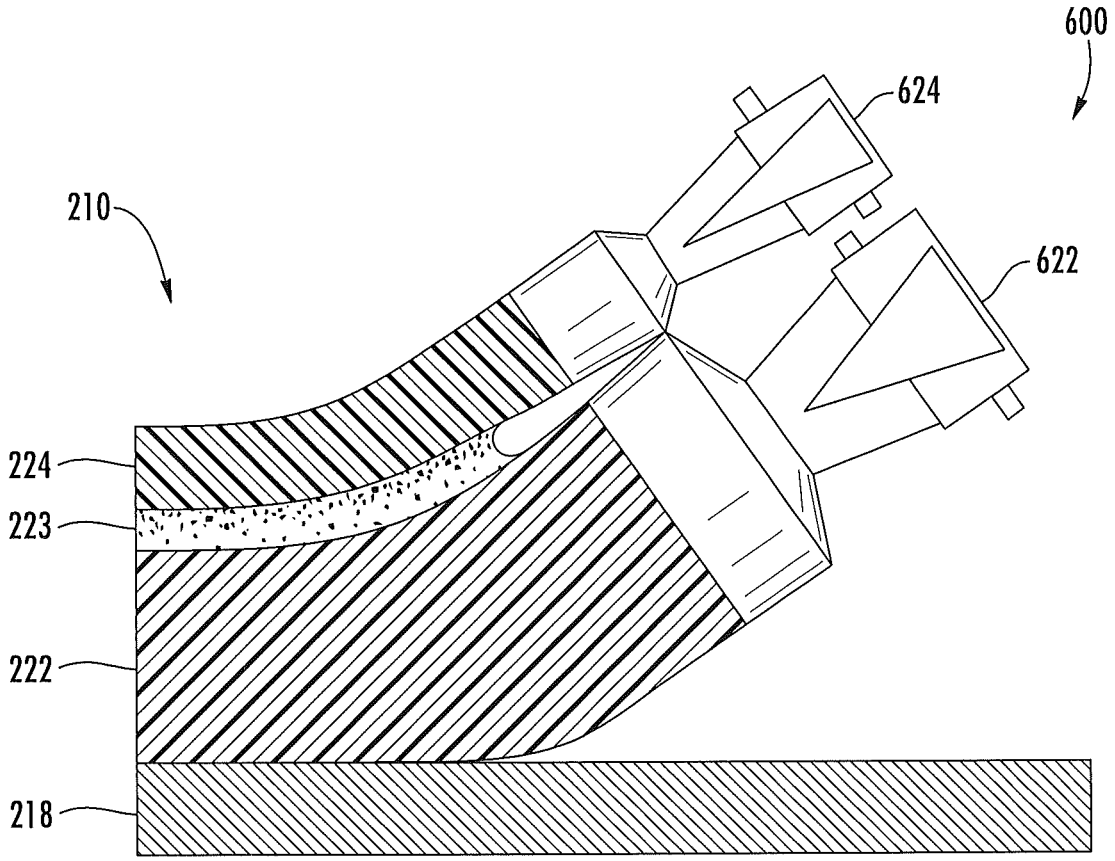
FIG. 4 is a greatly enlarged, partial section view of an industrial roll according to further embodiments of the present invention.

Referring now to FIG. 4, a roll 210 comprising, in overlying relationship, a base layer 218, a topstock layer 222, a transition layer 223, and a hydrophobic and/or amphiphobic coating 224 can be formed using a bi-layer coating mechanism comprising a bi-nozzle system 600 for a ribbon casing machine, such as a ribbon casting polyurethane machine. A bi-layer coating mechanism may be used to address a potential issue of poor bonding between a hydrophobic and/or amphiphobic coating 224 and topstock 222. The bi-nozzle system 600 can apply a bi-layer comprising a hydrophobic and/or amphiphobic coating 224 and topstock 222. The bi-nozzle system 600 can comprise a first nozzle 624 that casts a top ribbon comprising a hydrophobic and/or amphiphobic compound to form the coating 224 and that is placed directly above a second nozzle 622 that casts a bottom ribbon comprising a topstock material (e.g., a polyurethane or a rubber) without a hydrophobic and/or amphiphobic compound to form the topstock 222. The coating 224 can have a thickness between about 0.0625 inches and about 1.5 inches and in some embodiments between about 0.050 inches and about 0.250 inches. The topstock 222 can have a thickness between about 0.0625 inches and about 1.5 inches and in some embodiments between about 0.5 inches and about 1.5 inches. The two ribbons can be cast simultaneously and can provide interphase mixing between the two ribbons to form a transition layer 223. The transition layer 223 can comprise a concentration gradient of a hydrophobic and/or amphiphobic compound that decreases in concentration from the top ribbon to the bottom ribbon in the bilayer. The bi-layer coating mechanism can eliminate the distinct interphase that can be present between a hydrophobic and/or amphiphobic coating and a topstock containing no hydrophobic and/or amphiphobic compounds and can maximize the bonding strength between the coating and topstock. As described above, after application of the coating 224, the roll 210 can undergo further processing/finishing steps known to those skilled in this art.

An industrial roll comprising a hydrophobic and/or a amphiphobic roll cover can provide better release properties to the roll cover and can provide protection against water swelling and solvent attack. An industrial roll comprising a hydrophobic and/or a amphiphobic roll cover can prevent the buildup of papermaking materials on the roll cover during operation. Materials such as cellulose, paper fillers, deposits from recycled paper such as latexes, and deposits known as "stickies" can cause runnability issues with roll covers because they buildup on the surface of the covers. Thus, the industrial rolls of the present invention can reduce runnability issues caused by the buildup of papermaking materials on the roll cover during operation. In certain embodiments, a hydrophobic and/or amphiphobic roll cover can provide better sheet release, provide protection against water diffusion, and protect against solvent attack, especially for the case of amphiphobic roll cover.

Figure 5:
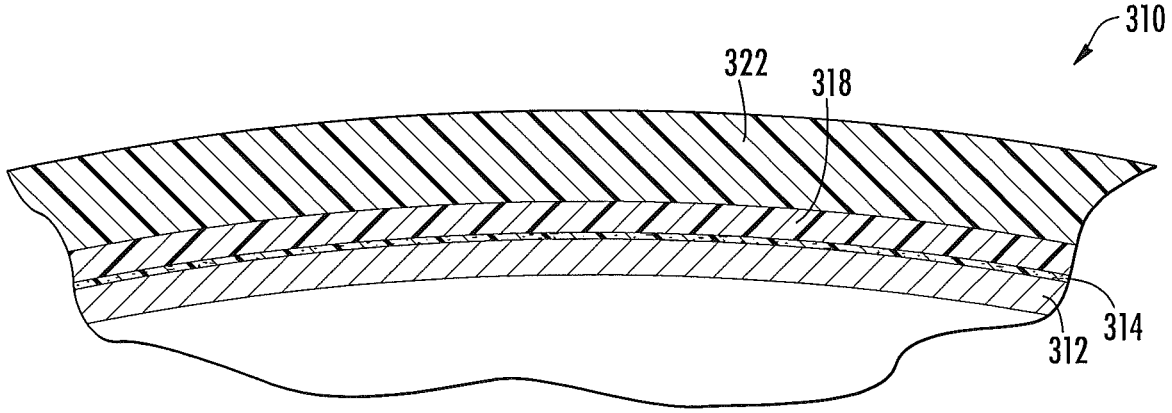
FIG. 5 is a greatly enlarged, partial section view of an industrial roll according to still further embodiments of the present invention.
Figure 6:
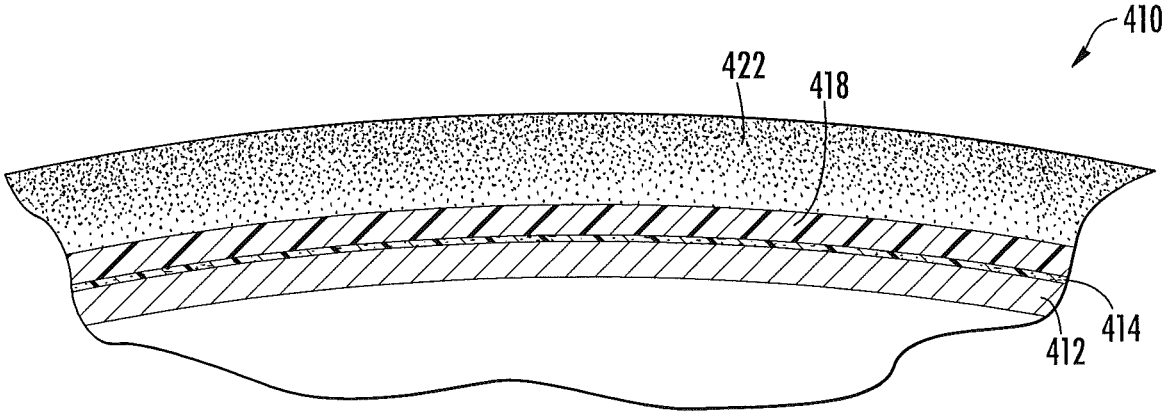
FIG. 6 is a partial front view of a bi-nozzle system for producing a cover for an industrial roll according to embodiments of the present invention.

Referring now to FIG. 5, in further embodiments the roll 310 comprises, in overlying relationship, a core 312, an adhesive layer 314, a base layer 318, and a topstock layer 322 comprising a hydrophobic and/or amphiphobic compound. The hydrophobic and/or amphiphobic layer 322 includes a hydrophobic and/or amphiphobic compound, such as PTFE and/or nano-silica, in an amount sufficient to provide the topstock layer 322 with hydrophobic and/or amphiphobic properties. A hydrophobic and/or amphiphobic topstock layer 322 can be applied to a roll 310 as described above. A hydrophobic and/or amphiphobic compound can be present in substantially the same concentration throughout the topstock 322 or the concentration of a hydrophobic and/or amphiphobic compound can vary throughout the topstock 322. As an example, the roll 410 of FIG. 6 comprises, in overlying relationship, a core 412, an adhesive layer 414, a base layer 418, and a topstock layer 422 comprising a concentration gradient of a hydrophobic and/or amphiphobic compound, wherein the concentration of the hydrophobic and/or amphiphobic compound increases in topstock 422 as the topstock 422 extends distally from the core 412. Referring to FIGS. 5 and 6, in certain embodiments, a topstock 322 or 422 can comprise two or more layers and each layer can comprise the same and/or a different concentration of a hydrophobic and/or amphiphobic compound as another layer.

Figure 7:
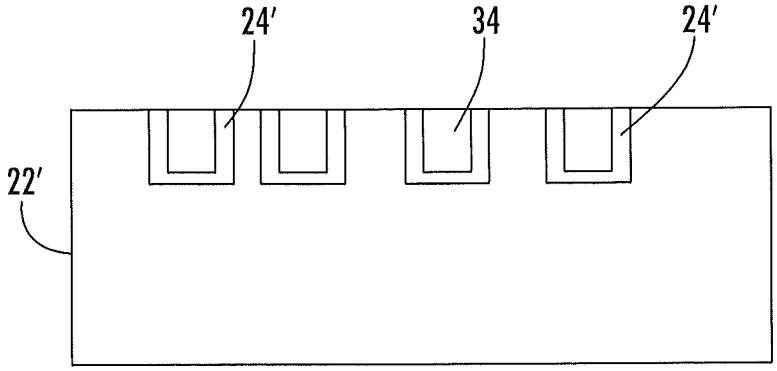
FIG. 7 shows a greatly enlarged, partial section view of a topstock layer having a plurality of recesses according to embodiments of the present invention.

According to some embodiments, a hydrophobic and/or amphiphobic coating can protect all or part of the inside of a recess, such as a groove, a through hole, and/or a blind drilled hole, on a roll cover. As illustrated in FIG. 7, a hydrophobic and/or amphiphobic coating 24' can coat some or all of an interior surface of a recess 34 in a topstock layer 22'. Coating an interior surface of a recess 34 with a hydrophobic and/or amphiphobic coating 24' can greatly improve water removal from a recess after exiting the nip in a paper machine. Also, coating an interior surface of a recess 34 with a hydrophobic and/or amphiphobic coating 24' can minimize the amount of surface exposed to water and/or solvent penetration and can limit water diffusion to one direction vertical to the working surface (i.e., from the surface toward the core). Further, coating an interior surface of a recess 34 with a hydrophobic and/or amphiphobic coating 24' can help to improve the long term compression performance of a roll cover under constant water and/or solvent attack. A hydrophobic and/or amphiphobic coating 24' on an inside surface of a recess 34 can increase the lifetime of a roll cover.

As those skilled in the art will appreciate, a hydrophobic and/or amphiphobic coating 24' on an interior surface of a recess 34 can comprise a hydrophobic and/or amphiphobic compound and optionally any suitable matrix material. The same or different matrix materials may be used in a hydrophobic and/or amphiphobic coating 24' on an interior surface of a recess 34 compared to the matrix materials used in a hydrophobic and/or amphiphobic coating on a surface of a roll. A coating 24' on an interior surface of a recess 34 can be carried out by any known mechanism. In certain embodiments, coating an interior surface is a recess 34 is carried out so that there is no excess force applied onto the interface and there is no abrasive nature at those surfaces. In some embodiments, a hydrophobic and/or amphiphobic coating 24' forms a self-assembled bionic micro- and/or nanostructure that repels water and/or an organic liquid.

The following examples are included to demonstrate embodiments of the present invention and are not intended to be a detailed catalog of all the different ways in which the present invention may be implemented or of all the features that may be added to the present invention. Persons skilled in the art will appreciate that numerous variations and additions to the various embodiments may be made without departing from the present invention. Hence, the following descriptions are intended to illustrate some particular embodiments of the invention, and not to exhaustively specify all permutations, combinations and variations thereof.

EXAMPLES

Example 1

Hydrophobic powder was incorporated into a solvent for a coating application. This mixture was then applied to the top layer of a polyurethane roll cover which created a hydrophobic surface. This mixture of solvent and hydrophobic powder was also applied between layers of polyurethane. This application was to simulate the addition of the hydrophobic powder into the ribbon of polyurethane during the casting process of roll covers. The incorporation of the hydrophobic powder into prepolymer as a filler was also achieved. Using a standard polyurethane formula, the hydrophobic filler was added at various loadings, blended, then cured to create a polyurethane cover that had hydrophobic characteristics not only on the surface of the polyurethane but throughout the entire cover.

Regarding hydrophobic roll covers, it was determined that the incorporation of functional hydrophobic filler may be a particularly feasible approach, as other currently available approaches which induce desirable surface patterns may not be able to withstand the abrasive operating conditions between the working roll covers surface and the passing sheets. It was suggested that the application of a hydrophobic surface, perhaps in the form of amphiphobic coating at the inside of a groove and a drill hole on the roll cover, may be desirable, considering it is not a working surface and the coating will only need to adhere well to the roll with much less stress imposed onto the interface. Additionally, this coating can protect the inside of grooves and drill holes, which can greatly improve the water removal exiting the nip. Another advantage of having this hydrophobic or amphiphobic surface at the inside of a groove and a drill hole is that it can minimize the amount of surface being exposed to water and solvent penetration and limit the water diffusion to one direction (from surface toward the core), thereby helping to improve the long term compression performance of the grooved and drilled roll cover under constant water and solvent attack. To realize a hydrophobic roll cover or a amphiphobic roll cover with a hydrophobic or amphiphobic working surface, it was suggested that the application method of thermal spray is a desirable option, in which case binding matrix mixed with functional filler may be either premixed or even precompounded as a solid feed. Multiple coating layers can be used to build up the final coating and the mixing ratio of each layer can be changed to maximize the adhesion of the coating to the surface while maximizing the functional filler loading on the surface layer without jeopardizing the adhesion strength at the interface. Also proposed was a bi-layer coating mechanism for a ribbon casting PU machine, in which a nozzle casting the top ribbon containing the functional filler is placed right on top of another nozzle containing the bottom ribbon without filler incorporation. The two ribbons are cast simultaneously and can provide interphase mixing between the two ribbons and form a gradient filler concentration from the top ribbon to the bottom ribbon, which can eliminate the distinct interphase and maximize the bonding strength.

Example 2

Isocyanate prepolymer resin 20 g
Teflon powder 6 g
High density polyethylene powder 7 g
Clay 2 g
Ethacure® 300 Curative 2.8 g The mixture described above was diluted with 60 grams of solvent (5:1 mixture of methyl ethyl ketone and toluene) and was sprayed onto the surface of a roll. After being cured at elevated temperature, the coating was ground with 180 grit sandpaper. The contact angle of finished surface was measured to be 123°. Ethacure® 300 curative is a liquid urethane curative available from Albemarle® Corporation of Baton Rouge, La.

Example 3

Isocyanate prepolymer resin 20 g
Teflon powder 15 g
Ethacure® 300 Curative 2.8 g The mixture described above was diluted with 60 grams of solvent (5:1 mixture of methyl ethyl ketone and toluene) and was sprayed onto the surface of a roll. After being cured at elevated temperature, the coating was ground with 180 grit sandpaper. The contact angle of finished surface was measured to be 140°.

Example 4

Isocyanate prepolymer resin 30 g
Teflon powder 9 g
Hydrophobic diatomaceous earth 1.5 g
Ethacure® 300 Curative 4.4 g The mixture described above was diluted with 60 grams of solvent (5:1 mixture of methyl ethyl ketone and toluene) and was sprayed onto the surface of a roll. After being cured at elevated temperature, the coating was ground with 180 grit sandpaper. The contact angle of finished surface was measured to be 145°.

Example 5

Isocyanate prepolymer resin 20 g
Teflon powder 10 g
High density polyethylene powder 5 g
Ethacure® 300 Curative 2.8 g The mixture described above was diluted with 60 grams of solvent (5:1 mixture of methyl ethyl ketone and toluene) and was sprayed onto the surface of a roll. After being cured at elevated temperature, the coating was ground with 180 grit sandpaper. The contact angle of finished surface was measured to be 132°.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An industrial roll, comprising:
a substantially cylindrical metallic core;
a base layer that is adhered to and circumferentially overlies the core;
a polymeric topstock layer that circumferentially overlies the base layer;
a hydrophobic or amphiphobic coating that circumferentially overlies the topstock layer; and
a transition layer between the topstock layer and the hydrophobic or amphiphobic coating, wherein the transition layer comprises an interphase mixing of the topstock layer and the hydrophobic or amphiphobic coating,
wherein the polymeric topstock layer comprises polyurethane and the hydrophobic or amphiphobic coating comprises at least two hydrophobic and/or amphiphobic compounds and a matrix material comprising polyurethane,
wherein the hydrophobic or amphiphobic coating comprises the at least two hydrophobic and/or amphiphobic compounds each in a ratio of about 5 parts to about 30 parts against 100 parts by weight of the polyurethane,
wherein the at least two hydrophobic and/or amphiphobic compounds are polytetrafluoroethylene (PTFE) and hydrophobic diatomaceous earth, each compound having a size in a range of about 10 nm to about 500 μm,
wherein the hydrophobic or amphiphobic coating has a contact angle greater than 120° for water.

2. The industrial roll of claim 1, wherein the hydrophobic or amphiphobic coating comprises two or more layers, wherein the two or more layers of the hydrophobic or amphiphobic coating form a concentration gradient of the hydrophobic and/or amphiphobic compound that increases in concentration as the two or more layers extend distally from the core.

3. The industrial roll of claim 1, wherein the topstock layer comprises a hydrophobic material.

4. The industrial roll of claim 1, wherein the topstock layer comprises a plurality of recesses having an interior surface coated with the hydrophobic or amphiphobic coating.

5. The industrial roll of claim 1, wherein the hydrophobic or amphiphobic coating has a thickness of about 0.005 to about 0.200 inches.

6. The industrial roll of claim 1, wherein the hydrophobic or amphiphobic coating is an amphiphobic coating and has a contact angle greater than 120° for water and an organic liquid.

7. The industrial roll of claim 1, wherein the at least two hydrophobic and/or amphiphobic compounds have a size in a range of about 10 nm to about 1 μm.

8. The industrial roll of claim 1, wherein the hydrophobic or amphiphobic coating is bionic.

9. The industrial roll of claim 1, wherein the hydrophobic or amphiphobic coating further comprises a hydrophobic nanomaterial, wherein the hydrophobic nanomaterial is nano-silica.

10. The industrial roll of claim 9, wherein the hydrophobic nanomaterial has a size in the range of about 10 nm to about 500 μm.

11. The industrial roll of claim 1, wherein the base layer comprises epoxy.

12. A method of constructing an industrial roll having a hydrophobic or amphiphobic coating, the method comprising the steps of:
providing a substantially cylindrical metallic core;
applying a base layer that circumferentially overlies the core; and
applying a bi-layer over the base layer, the bi-layer comprising a topstock layer that circumferentially overlies the base layer and a hydrophobic or amphiphobic coating that circumferentially overlies the topstock layer, the topstock layer and the hydrophobic or amphiphobic coating being applied simultaneously such that an interphase mixing occurs between the topstock layer and the hydrophobic or amphiphobic coating to form a transition layer between the topstock layer and the hydrophobic or amphiphobic coating;
wherein the topstock layer comprises polyurethane,
wherein the hydrophobic or amphiphobic coating comprises polytetrafluoroethylene (PTFE), a hydrophobic diatomaceous earth, and a matrix material comprising polyurethane in a ratio of about 1 part to about 50 parts by weight of PTFE against 100 parts by weight of the polyurethane, and about 1 part to about 50 parts by weight of hydrophobic diatomaceous earth against 100 parts by weight of the polyurethane, and wherein PTFE and hydrophobic diatomaceous earth each have a size in a range of about 10 nm to about 500 μm.

13. The method of claim 12, wherein the transition layer comprises a concentration gradient of a hydrophobic and/or amphiphobic compound that increases in concentration as the transition layer extends distally from the core.

* * * * *